US005415328A

United States Patent [19]

Miyazaki

[11] Patent Number: 5,415,328

[45] Date of Patent: May 16, 1995

[54] SPRAY MECHANISM OF AEROSOL PRODUCT

[75] Inventor: Kiwamu Miyazaki, Osaka, Japan

[73] Assignee: Kyowa Industrial Co., Ltd., Osaka, Japan

[21] Appl. No.: 19,449

[22] Filed: Feb. 18, 1993

[51] Int. Cl.[6] ..... B65D 83/14

[52] U.S. Cl. ..... 222/396; 137/505.41; 222/402.13; 222/635

[58] Field of Search ..... 222/396, 402.1, 402.13, 222/635; 137/505.39, 505.41

[56] References Cited

U.S. PATENT DOCUMENTS

| | | | |
|---|---|---|---|
| 5,042,697 | 8/1991 | Warren | 222/402.1 |
| 5,070,901 | 12/1991 | Black | 137/505.41 X |
| 5,080,266 | 1/1992 | O'Neill | 222/635 |
| 5,143,077 | 9/1992 | Kobayashi | 137/505.41 X |
| 5,158,215 | 10/1992 | Comment | 222/396 |

FOREIGN PATENT DOCUMENTS

| | | | |
|---|---|---|---|
| 783199 | 6/1935 | France | 137/505.39 |
| 1166073 | 7/1985 | U.S.S.R. | 137/505.39 |
| 8604163 | 12/1985 | WIPO | 222/402.1 |

*Primary Examiner*—Andres Kashnikow
*Assistant Examiner*—Joseph A. Kaufman

[57] ABSTRACT

A container containing a liquid and vaporizing gas to be sprayed is provided with a control member having a spray hole, and when the control member is manipulated, the liquid is sprayed by the gas pressure of the spraying gas. A sliding member is provided in the control member, and a pool is installed in the passage of the spray liquid and the vaporizing gas. When the gas pressure in the pool is raised to a specified pressure, the sliding member works to close the passage, and when the gas pressure in the pool drops, the passage is opened, and the gas pressure is built up. As a result, the spray liquid and the gas are temporarily stored in the pool until raised to the specified internal pressure, and then sent into the spray hole, so that the spray liquid is always sprayed from the spray hole at a specific pressure, so that a specific spray state and atomization state may be always maintained.

10 Claims, 7 Drawing Sheets

SPRAY MECHANISM OF AEROSOL PRODUCT

BACKGROUND OF THE INVENTION

1. Field of the Invention

The present invention relates to an improvement for a spray mechanism of an aerosol product for injecting the spray liquid from the container by a gas pressure by means of a vaporizing gas for spraying.

2. Description of Related Art

As the spraying mechanism an aerosol product using vaporizing gas a spraying gas, and injecting the spray liquid from the container by the gas pressure of this spraying gas, for example, the construction as shown in FIG. 7 has been previously known.

The device of FIG. 7 includes a container and a control member b, wherein the control member b is provided with a nozzle fitting hole c for fitting with the front end of a nozzle a1 of the container a, an injection hole d, and a leading path e for communicating with the nozzle fitting hole c and injection hole d, and by pressing down the control member b engaged with the front end of the nozzle a1 of the container a, the spray liquid in the container a moves from the nozzle a1 to the leading path e, and is injected from the spray hole d.

In FIG. 7, when the spray liquid decreases in the container a as a result of consumption, the gas space increases accordingly, and the internal pressure in the container decreases. As a result, when the container a is initially filled with the spray liquid and gas, the spray liquid is abundantly injected forcibly from the spray hole d, but when the remainder of the spray liquid becomes less than half, the injection of the spray liquid is no longer forcible, and a sufficient amount of spray liquid cannot be injected, and the state of atomization is poor at the same time.

Although not shown, as another spray mechanism for an aerosol product, aside from the type shown above, the so-called tilt type has been widely used, in which the liquid is injected from the spray hole by tilting the nozzle of the container.

In this tilt type, same as in the above type, the spray liquid forced out from the nozzle a1 by gas is injected from the spray hole by way of the leading path. Therefore, in this tilt type, too, as compared with the initial state, the injection force and atomization state of the spray liquid are poor near depletion of the container, and the same problems as above are present.

On the other hand, the conventional spray mechanism for an aerosol product was developed on the basis of using liquified gas represented by chlorofluorocarbons as the spraying gas. Such liquifies gas is gradually vaporized in the container a by proper amounts, so that the pressure in the container is kept almost constant from the beginning to the end of use, and the problems of deterioration of injection force and worsening of the atomization state were not apparently obvious.

However, disuse of chlorofluorocarbons has been decided from the viewpoint of environmental protection, and use of other liquefied gas such as LPG is difficult from the standpoint of safety. Hence, today, it is attempted to use $CO_2$, $N_2$, $O_2$ and other vaporized gases as the spraying gas.

These vaporized gases (especially $N_2$) are not dissolved well in spray liquid, and are mostly contained in the container a in a vaporized state. Accordingly, when used in the conventional spraying mechanism of an aerosol product, initially, the spray liquid is released at a high pressure, during contained use, the gas space increases, and the gas pressure in the container drops, and the container pressure is extremely low near the end of the content. As a result, the problems of deterioration of injection force and worsening of atomization state become manifest.

Still more, when liquified gas is used, a part of the liquified gas is injected together with the spray liquid. Hence, a part of the liquified gas is vaporized at the moment it is expelled from the nozzle a1, and acts to transform the spray gas into a fine mist, but in the case of vaporized gas, since it is not dissolved smoothly in the spray liquid, injection in such a fine mist state is not expected.

The invention is devised in light of these problems, and it is hence a primary object thereof to present a spray mechanism for an aerosol product capable of always maintaining a specific spray state and mist state from beginning until the end of use even when using vaporized gas.

It is another object of the invention to present a spray mechanism for an aerosol product capable of injecting a favorable fine mist even by using vasporized gas.

BRIEF SUMMARY OF THE INVENTION

The invention solves the above problems by presenting a spray mechanism for an aerosol product possessing the following features.

The invention presents a spray mechanism of aerosol product, in which a container containing at least a spray liquid and a spraying gas in its inside is provided with a control member possessing a spray hole, and as the control member is manipulated, the spray liquid is sent into the spray hole by the gas pressure of the spraying gas from a nozzle hole of a nozzle provided in the container, so that the spray liquid is injected from the spray hole.

The control member comprises a control part for manipulating the nozzle so as to inject the spray liquid from the nozzle hole, a regulator mechanism unit communicating with the nozzle hole, and the spray hole communicating with the regulator mechanism unit.

The regulator mechanism unit comprises a space formed at the front end side of the nozzle in the control member, a sliding member provided slidably in the space, and thrusting means for thrusting the sliding member always to the nozzle side.

The space possesses a nozzle opening formed at the front end side of the nozzle so as to communicate with the nozzle hole, a communicating part to communicate with the nozzle opening, and a connection hole disposed therebetween for communication purposes.

The sliding member possesses a partition wall disposed in the communicating part, and a shielding part disposed in the nozzle opening and connected to the partition wall to be movable together with the partition wall. The sliding member is intended to slide in the direction resisting the thrusting force of the thrusting member by receiving pressures more than the thrusting force of the thrusting means by the spray liquid and gas released from the nozzle hole.

The shielding part is to shield the connecting hole by clogging from the nozzle side along with the sliding motion of the sliding member in the direction resisting the thrusting force of the thrusting means.

As the partition wall slidably contacts with the inner circumference of the communicating part, it communicates with the nozzle opening in the communicating part, thereby forming a pool for temporarily storing the spray liquid flowing in from the nozzle opening and the gas dissolved partly in the spray liquid.

The pool has communicating means for communicating between the pool and the spray hole, and the spray liquid and gas reserved in the pool until raised to the specified pressure are sent into the spray hole through the communicating means.

The invention further presents a spray mechanism for an aerosol product in which the communicating means are composed of a communicating hole communicating with the pool, and a narrow communicating path for linking the communicating hole and the spray hole.

The invention also presents a spray mechanism for an aerosol product in which the communicating means are composed of a narrow leading path communicating with the pool, a communicating hole connected with the leading path, and a wide communicating path for communicating with the communicating hole and spray hole.

The invention still more presents a spray mechanism for an aerosol product in which the container contains a spray liquid, an arbitrary liquified gas dissolved in the spray liquid, and a vaporized gas agent for spraying.

In the invention, the control member is provided with a regular mechanism unit for partitioning the pool for temporarily storing the spray liquid delivered at an adequate pressure from the nozzle hole, and communicating means for storing the spray liquid and gas in the pool so as to raise to a specific internal pressure inside the pool, while sending the spray liquid stored in the pool to the spray hole at the specific internal pressure.

As a result, the spray liquid sent out of the nozzle hole at a proper pressure is once stored in the pool, and is then forwarded into the spray nozzle after reaching the specific pressure.

Therefore, regardless of the internal pressure of the container by the spraying gas, the spray liquid can be injected from the spray hole at the specific pressure always maintained in the pool.

Furthermore, by dissolving a desired liquified gas in the spray liquid, when the spray liquid is injected, the liquified gas is vaporized, and the spray liquid is injected in a fine mist.

DETAILED DESCRIPTION OF THE PREFERRED EMBODIMENTS

Figure 1:
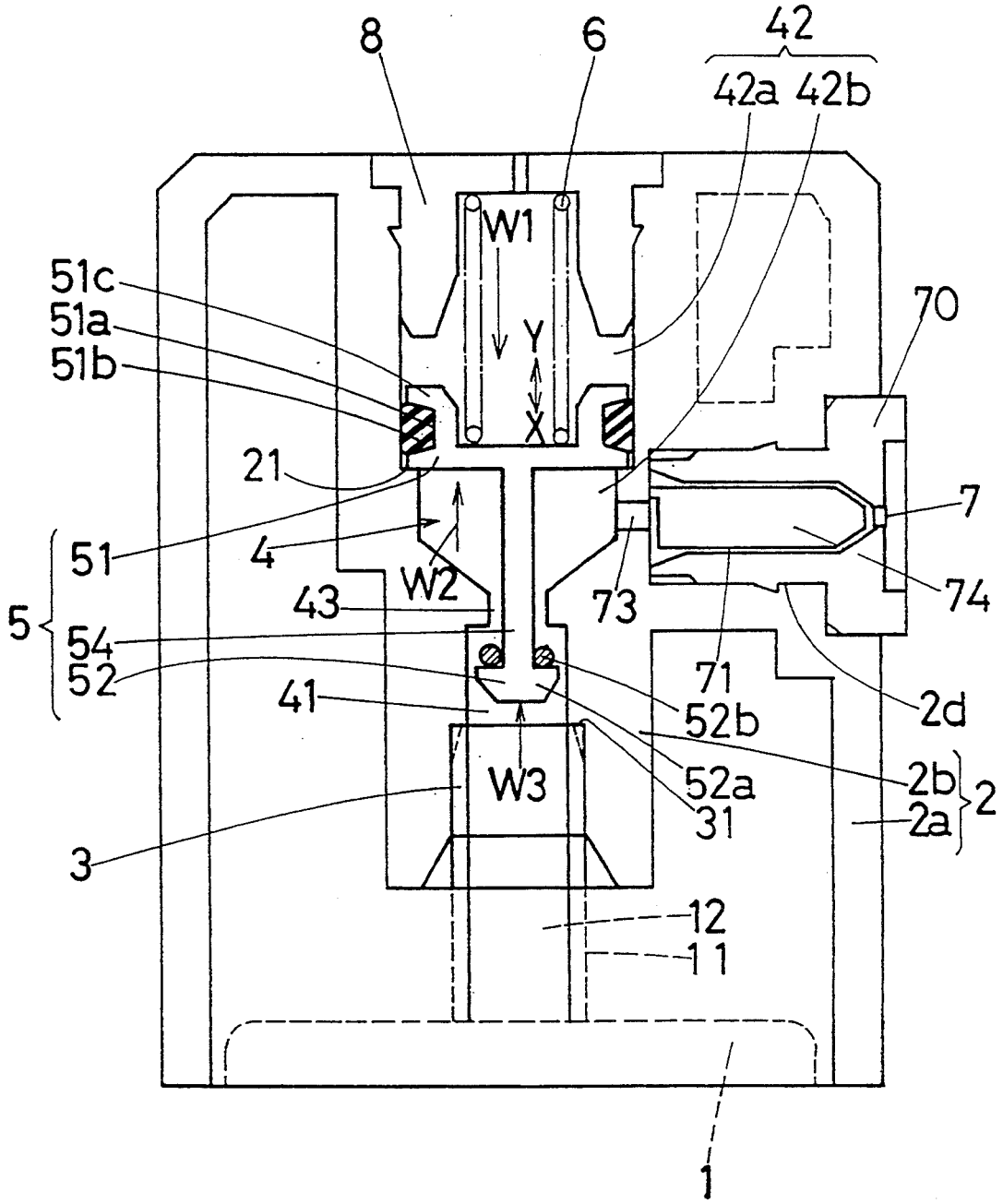
FIG. 1 is an explanatory diagram of an internal structure of an embodiment of the invention.

Referring now to the drawings, some of the preferred embodiments of the invention are described in detail below.

Figure 2:
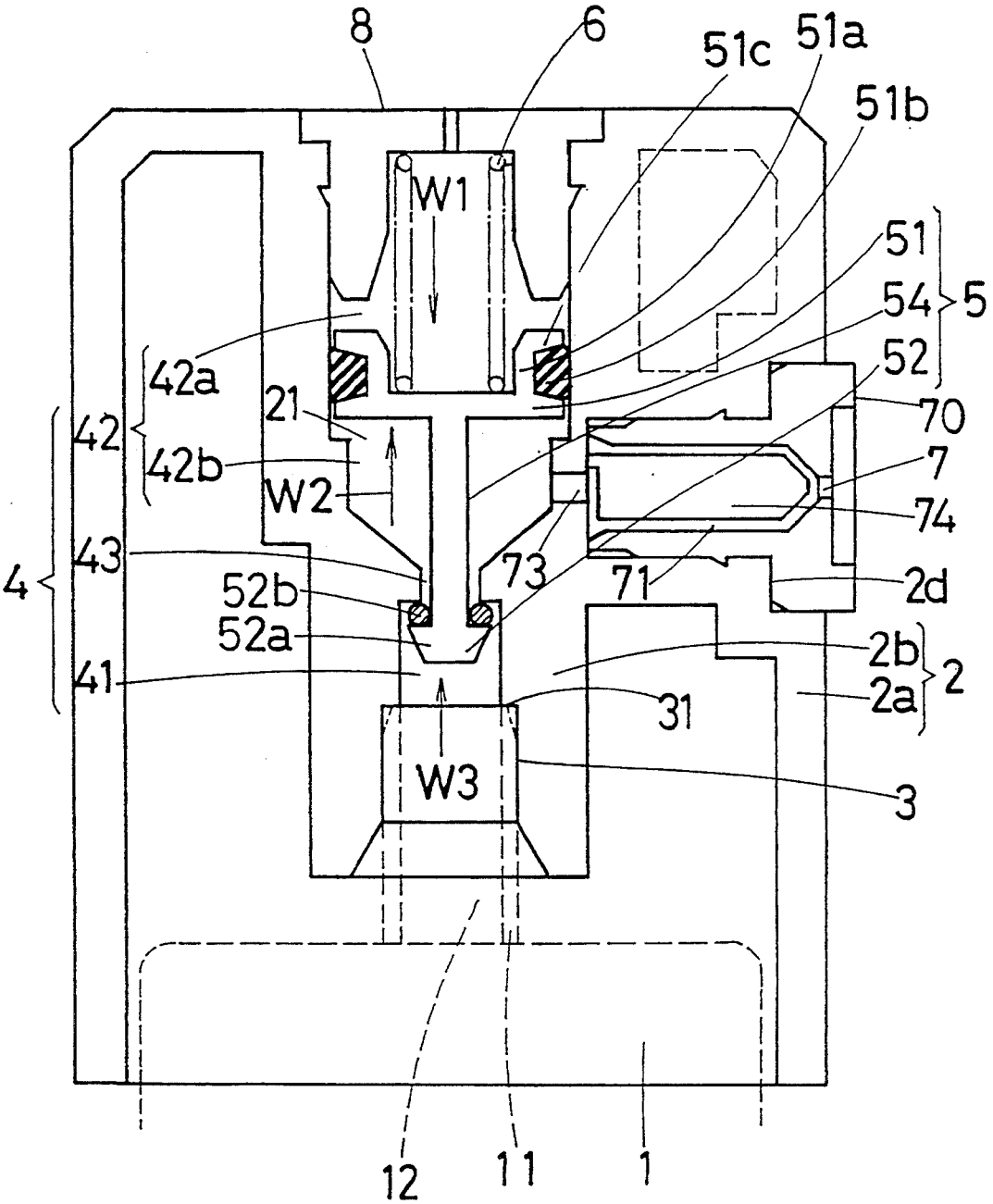
FIG. 2 is an explanatory diagram of an internal structure showing an injection state in an embodiment of the invention.

FIG. 1 is a fragmentary enlarged sectional view of an embodiment of the invention, and FIG. 2 is a fragmentary enlarged sectional view of the injection state.

The spray mechanism for an aerosol product of the invention comprises a container 1, and a control member 2 attached to the container 1.

The container 1 for mounting the control member 2 is the same as in the prior art, and is filled with a vaporized gas as spraying as such as air, carbon dioxide, nitrogen, laughing gas and oxygen, together with various spray liquids such as perfume, insecticide and paint. In the upper part of the container 1, a tubular nozzle 11 possessing a nozzle hole 12 is provided. The nozzle 11 in the embodiment is designed to inject the spray liquid from the nozzle hole 12 by pressing down the nozzle 11, and to stop the spray liquid by releasing the nozzle so as to be pushed up by thrusting means attached to the nozzle 11. Alternatively, the tilt type of injecting the spray liquid by pressing and tilting the nozzle 11 may be equally employed.

The control member 2 comprises an operation part, a regulator mechanism unit, and a spray hole 7. In this embodiment, the control member 2 is formed in a double cylindrical wall structure consisting of an outer wall **2*a* for forming an outer peripheral wall and an inner wall 2*b* for forming an inner peripheral wall as shown in FIG. 1, and the operation part and the regulator mechanism unit are provided inside the inner wall 2*b*, and the spray hole 7 is provided on the periphery of the outer wall 2*a***.

The operation part has a nozzle fitting hole 3 formed in the lower part of the inner periphery of the inner wall **2*b*. This nozzle fitting hole 3 has a nozzle upper end abutting part 31 provided by forming a step by reducing the inner diameter of the inner wall 2*b* in the portion of a specific depth from the lower end in its upper part, and when the upper end of the nozzle 11 of the container 1 abuts against the nozzle upper end abutting part 31, only the upper part of the nozzle 11 is fitted, and as the nozzle upper end abutting part 31 presses the control member 2 down the nozzle 11** is pushed downward.

The regulator mechanism unit comprises a space 4 inside of the inner wall **2*b* formed in the middle of the container 2, a sliding member 5 disposed in the space 4 so as to slide in the axial direction (the X-Y direction in the diagram) of the nozzle 11 inside the space 4, and thrusting means 6 for thrusting the sliding member 5 always to the nozzle 11** (the X-direction in the diagram) side.

The space 4 is trapped by an upper lid 8 provided in engagement with the inner circumferential upper part of the inner wall **2*b* in its upper part, and the space 4 comprises, in its inside, a nozzle opening 41 formed at the front end side of the nozzle 11, a communicating part 42 communicating continuously with the nozzle opening 41, and a connecting hole 43 for communicating between the two. In this embodiment, the connecting hole 43 is provided above a certain distance from the nozzle fitting hole 3 in the inner circumference of the inner wall 2*b*, the inner diameter of the inner wall 2*b* is smaller than the diameter of the nozzle fitting hole 3, and a step is formed in the boundary to the nozzle opening 41, so that the nozzle opening 41 and the communicating part 42** are formed in mutual communication.

The sliding member 5 is, in this embodiment, composed of an upper disc-shaped partition wall 51, a protrusion 54 projecting downward from the lower surface of the partition wall 51, and a shield part 52 formed at the end of the protrusion 54, which are formed in one body.

The partition wall 51 comprises a disc-shaped partition wall main body 51*c*, a groove 51*a* formed along the whole circumference of the partition wall main body 51*c*, and a ring-shaped enclosing member 51*b* as means for enclosing to be fitted into the groove 51*a*. The partition wall 51 is disposed in the communicating part 42 so as to divide the communicating part 42 into the upper thrusting means compartment 42*a* and lower 42*b*. The pool 42*b* formed by the partition wall 41 is completely separated from the thrusting means compartment 42*a* by tightly closing the whole internal circumference of the partition wall 51 and inner wall 2*b* by the enclosing member 51*b*, and the spray liquid in the container 1 getting in the pool 42*b* does not escape into the thrusting means compartment 42*a*, and the spray liquid discharged from the nozzle hole at a proper pressure is temporarily stored. The pool 42*b* is also equipped with communicating means for communicating between the pool 42*b* and the spray hole 7.

The communicating means holds the spray liquid and gas in the pool 42*b* so that the internal pressure in the pool 42*b* may be raised to a specified value, and with this specified internal pressure, the spray liquid staying in the pool 42*b* is sent into the spray hole 7. In this embodiment, this communicating means is composed of communicating hole 73 opened in the inner circumference of the pool 42*b*, a leading path 71 for connecting the communicating hole 73 and spray hole 7 which is described later, and the spray hole 7.

The protrusion 54 is a round bar, of which the diameter is smaller than the diameter of the connecting hole 43 formed between the nozzle opening 41 and the communicating part 42, and its front end side is extended into the nozzle opening 41 by communicating through the connecting hole 43.

The shielding part 52 is disposed in the nozzle opening 41, and is composed of a flange 52*a* and a shielding member 52*b*. The flange 52*a* has its upper outer diameter larger than the diameter of the connecting hole 43, and smaller than the diameter of the nozzle opening 41, and its lower surface is a flat plane, and it is disposed so that the entire lower surface may be orthogonal to the axial direction of the nozzle 11, so that the spray liquid and gas in the container 1 delivered through the nozzle hole 12 may contact with this lower surface. On the other hand, the shielding member 52*b* is made of an elastic ring-shaped material, and is wound around the protrusion 54 in the upper part of the flange 52*a*. The outer diameter of the shielding member 52*b* is larger than the diameter of the connecting hole 43 in the state being wound on the protrusion 54, thereby clogging the connecting hole 43.

As the thrusting means 6, in the embodiment, a cylindrical coil spring 6 is used, and is set between the partition wall 51 and upper lid 8 so that the lower end may abut against the upper surface of the partition wall 51 and the upper end against the lower surface of the upper lid 8, and is disposed in the thrusting means disposing compartment 42*a*, and normally when the spray liquid and gas are not supplied into the pool 42*b* from the nozzle 11 as shown in FIG. 1, it is stopped in the thrust state by pushing from above to the partition wall stopping part 21 provided in the inner peripheral wall in the upper part of the communicating hole 73.

The spray hole 7 is, in this embodiment, provided in a spray member 70 made separately from the control member 2, and is composed as the spray member 70 is mounted on the control member 2. The spray member 70 possesses a leading path 71 communicating with the pool 426i b in the regulator mechanism unit being disposed in the left part, and the spray hole 7 formed at the right end of the leading path 71. The leading path 71 is composed of a hole formed in the left part of the spray member 7, and a cylindrical chip member 74 disposed in this hole, and the narrow gap formed between the hole and the outer circumference of the chip member 74 forms the leading path 71. The spray hole 7 is a tiny hole, and ejects the spray liquid forced out from the leading path 71 in a mist state through the spray hole 7. This spray member 70 is engaged with spray member fitting hole 2*d* provided in the outer wall 2*a* of the control member 2 so that the communicating hole 73 of the control member 2 and the leading path 71 communicate with each other, but since the leading path 71 is narrow and the spray hole 7 is tiny, the spray liquid and the gas to be delivered are limited until ejected from the communicating hole 73, thereby functioning as the communicating means.

The operation of the spray mechanism is described below.

First, the nozzle 11 if the container 1 is inserted into the nozzle fitting hole 3 of the control member 2, and the control member 2 is attached to the container 1. In this installed state, as shown in FIG. 1, the sliding member 5 is thrust by the cylindrical coil spring 6, and the lower end outer periphery of the partition wall 51 of the sliding member 5 is stopped on the partition wall stopping part 21 of the inner wall 2*b* in a state of being pushed down, while the shielding part 52 is positioned nearly in the middle in the vertical direction of the nozzle opening 41, thereby keeping open the connecting hole 43.

Consequently, the top of the control member 2 is pressed down by hand. As a result, the nozzle 11 is pushed down by the nozzle upper end abutting part 31 of the nozzle fitting hole 3, and the spray liquid in the container 1 is ejected from the nozzle hole 12 by the pressure of the vaporized gas in the container 1. The ejected spray liquid hits against the lower surface of the shielding part 52, and is loaded with a pressure W3 in the upward direction, and gets into the pool 42*b* through the connecting hole 43 in the open state from the gap between the outer circumference of the shielding part 52 and inner circumference of the nozzle opening 41. When a certain amount of spray liquid and gas gets into the pool 42*b*, the internal pressure W2 in the pool 42*b* is raised by the spray liquid pushed out by the gas. At this time, the spray liquid getting into the pool 42*b* also flows into the leading path 71 of the spray member 7 from the communicating hole 73, but since the amount is smaller than the volume getting into the pool 42*b* from the nozzle 11, the internal pressure W2 in the pool 42*b* increases instantly.

When the internal pressure W2 further increases until the sum W2+W3 of the internal pressure W2 applied to the partition wall 51 of the sliding member 5 forming the upper surface of the pool 42*b* and the pressure W3 applied on the lower surface of the shielding part 52 becomes larger than the thrusting force W1 for thrusting down the sliding member 5 by the cylindrical coil spring 6, the sliding member 5 is pushed upward. At this time, successively, the spray liquid in the pool 42*b* is sent into the leading path 71 of the spray member 7 through the communicating hole 73. When the sliding member 5 is pushed up, as shown in FIG. 2, the shielding member 52*b* of the shielding part 52 closes the communicating hole 43 from beneath, thereby establishing a closed state. Therefore, inside the pool 42*b*, the internal pressure W2 is no longer elevated, and the spray liquid is sent into the leading path 71 of the spray part 7 at this internal pressure W2.

When the spray liquid is sent into the leading path 71 to a certain extent, the internal pressure W2 in the pool 42*b* begins to drop gradually until the sum pressure W2+W3 is lower than the thrusting force W1 of the cylindrical coil spring 6, and then the sliding member 5 slides down, substantially stopping the feed of spray liquid and gas into the leading path 71 of the spray member 7, while the connecting hole 43 is opened again. Consequently, the spray liquid begins to enter the pool 42*b* again and the sum pressure W2+W3 builds up, and the spray liquid in the pool 42*b* is sent from the communicating hole 73 into the leading path 71 of the spray member 70, while the sliding member 5 is pushed upward at the same time. Thereafter, by repeating this process instantly, the spray liquid is ejected from the spray hole 72 in a mist state always at the internal pressure W2. Therefore, from beginning till end of use, the spray liquid is sent out always at a constant pressure of W2, and a constant spray state and mist state may be maintained. Incidentally, by using various cylindrical coil springs 6 with different thrusting forces, an appropriate pressure may be easily adjusted.

This has been the explanation of operation.

Referring then to FIGS. 3 to 6, other embodiments are described below.

Figure 3:
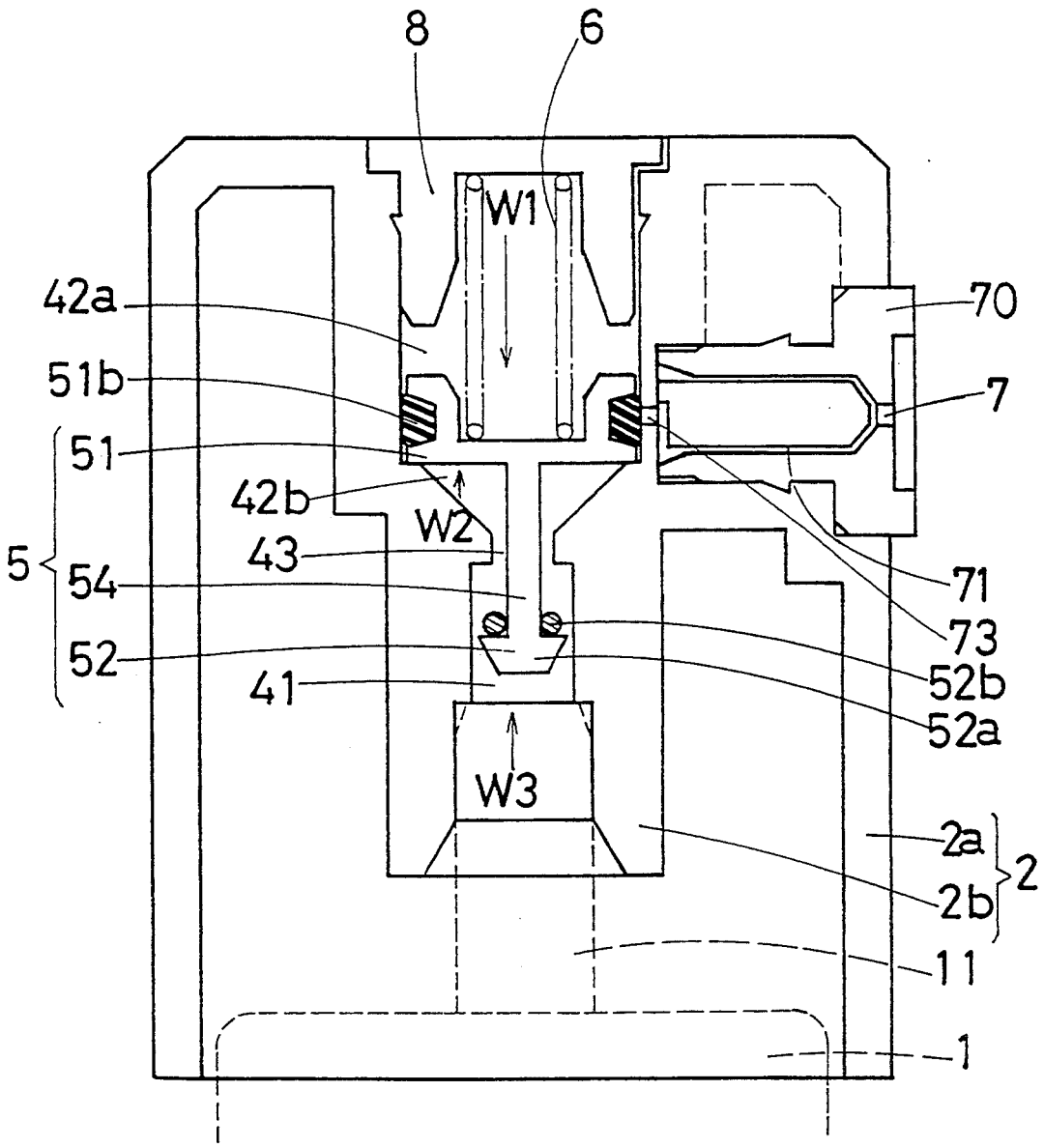
FIG. 3 is an explanatory diagram of an internal structure of another embodiment.

In the embodiment shown in FIG. 3, the nozzle fitting hole 3 as the operation part of the control member 2, regulator mechanism unit, and spray member 70 are the same as in the foregoing embodiment. What is different is that the partition wall stopping part 21 for stopping the partition wall 51 of the sliding member 5 is disposed below the communicating hole 73 for communicating between the pool 42*b* and the leading path 71 of the spray member 7. As shown in FIG. 3, in the state of not operating the nozzle 11, that is, in the state in which the sliding member 5 receives only the thrusting force W1 of the cylindrical coil spring 6, the communicating hole is closed by the enclosing member 51*b* of the sliding member 5, by installing communicating means.

Figure 4:
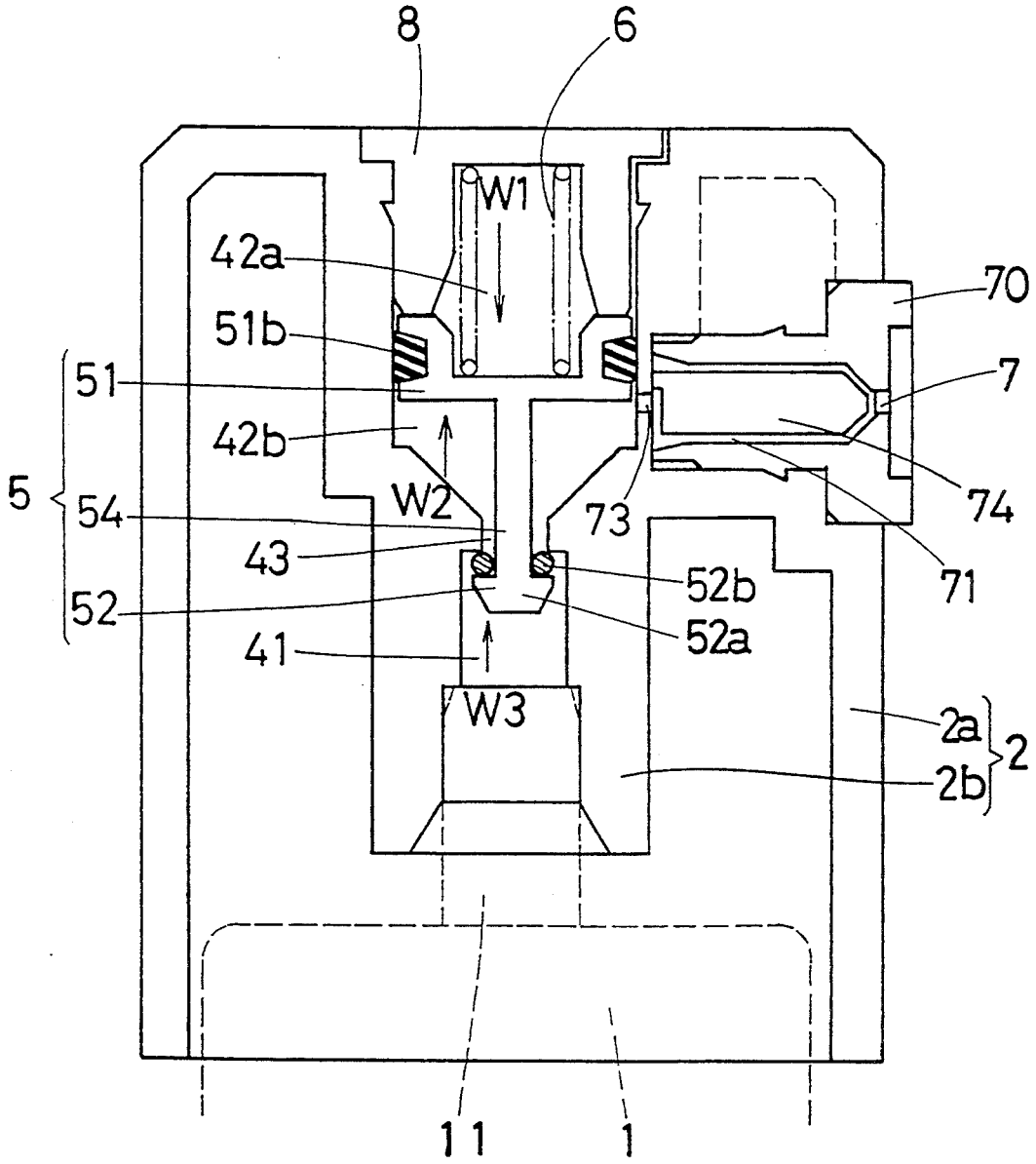
FIG. 4 is an explanatory diagram of an internal structure showing an injection sate in the embodiment of FIG. 3.

Consequently, as shown in FIG. 4, the spray liquid is pushed up by the pressure of the vaporized gas, and only when the pool 42*b* achieves a specific pressure is the communicating hole connected with the pool 42*b*, so that the spray liquid may be sent into the spray part 7 at the specific pressure. As the spray liquid is sent forth, the internal pressure in the pool 42*b* drops from the specific level, then the communicating hole 73 is closed by the enclosing member 51*b*. Therefore, until the internal pressure in the pool 42*b* reaches the specified level, the spray liquid in the pool 42*b* is securely prevented from flowing into the spray member 70, so that the spray liquid may be injected always at the specific pressure only.

Figure 5:
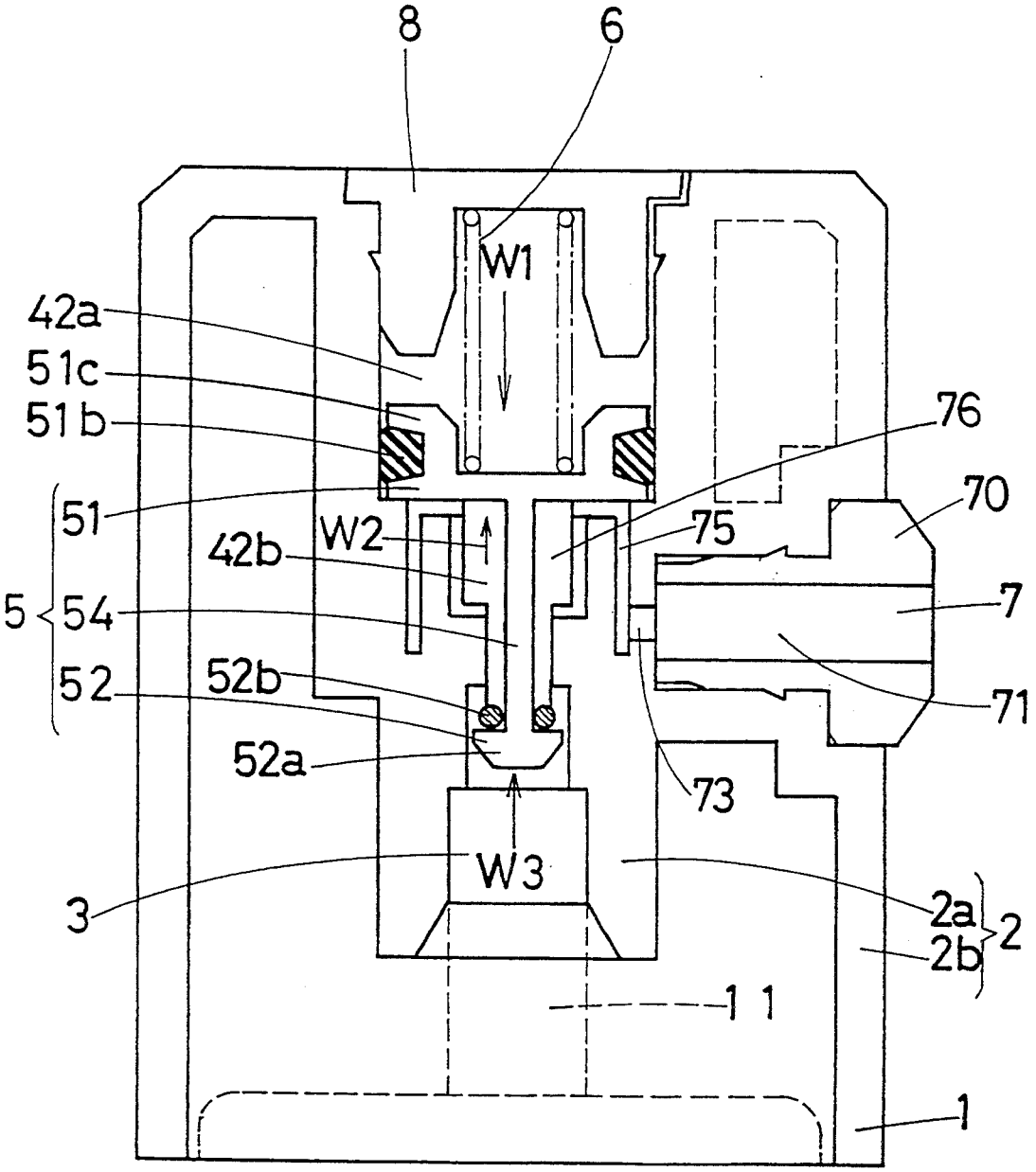
FIG. 5 is an explanatory diagram of an internal structure of still another embodiment.

In the embodiment shown in FIG. 5, the leading path 71 of the spray member 70 and the spray hole 7 have a large diameter, and a narrow guide path 75 is disposed in the outer part of the pool 42*b* consecutively to the communicating hole 73. As in the preceding embodiments, in the case of the spray member 70 of so-called break-up type having the leading path 71 of the spray member 70 and the spray hole 7 in a smaller diameter, the amount sent into the leading path 71 from the pool 42*b* is smaller than the quantity collected in the pool 42*b* as mentioned above, and therefore the internal pressure is instantly built up in the pool 42*b*. However, in the case of this embodiment employing the spray member 70 of the so-called straight type, the spray liquid is sent out from the pool 42*b* to the leading path 71 until the internal pressure is built up in the pool 42*b*. Accordingly, the guide path 75 is provided in the pool 42*b* to prevent such flow, so that the specified internal pressure may be built up in the pool 42*b*. In the diagram, numeral 76 denotes a plate member. This plate member 75 is provided in a plurality of equal intervals in the circumferential direction so as to project outward in the radial direction from the outer circumference of the sliding member 5, thereby preventing the sway of the sliding member 5 when the sliding member 5 moves up and down and moving the sliding member 5 smoothly up and down.

Figure 6:
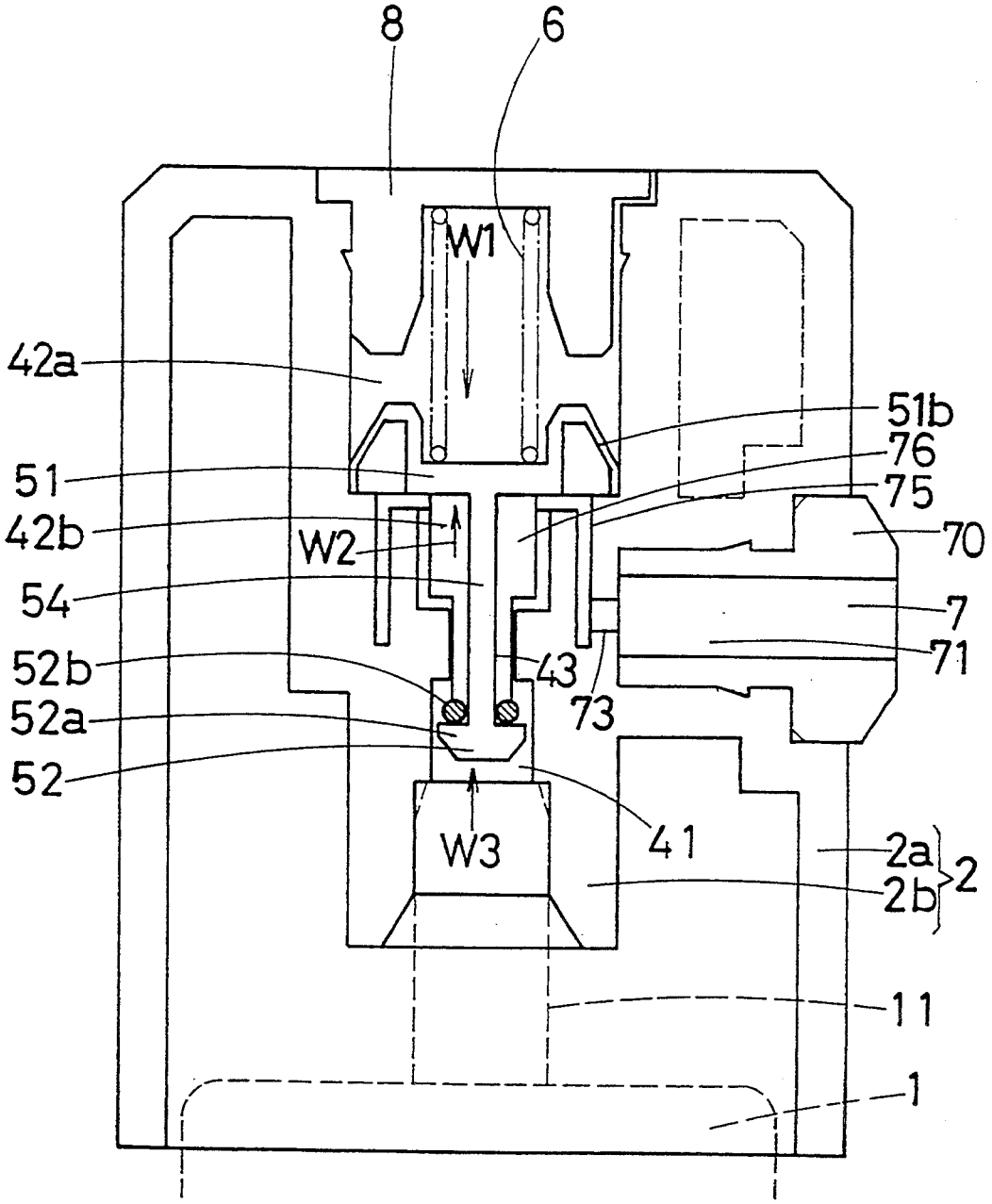
FIG. 6 is an explanatory diagram of an internal structure of a different embodiment.
Figure 7:
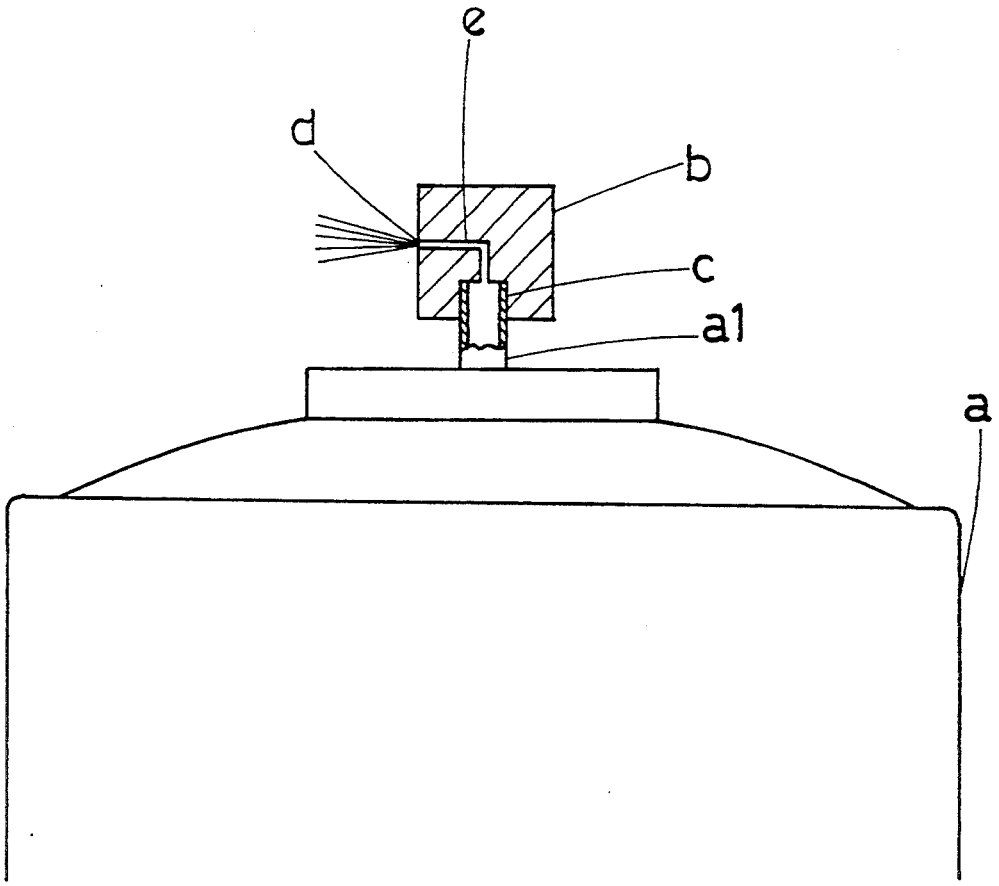
FIG. 7 PRIOR ART
FIG. 7 is a sectional view of the prior art.

In the embodiment shown in FIG. 6, same as the embodiment shown in FIG. 5, the spray member 70 of straight type is used, and a guide path 75 is provided in the pool 42*b*, wherein the enclosing member 51*b* of the sliding member 5 is formed integrally with the sliding member 5. Hence, the job efficiency in assembly may be enhanced, and the manufacturing cost is lower.

Thus, as the spraying gas, various vaporized gases may be used. These vaporized gases (especially $N_2$) are hardly dissolved in the spray liquid, and the spray liquid is hardly atomized at the time of spraying, and it is difficult to obtain a fine mist.

Hence, only the spray liquid and the vaporizing gas may be contained in the container 1, but preferably, a slight amount of liquified gas is dissolved in the spray liquid and contained in the container.

As the liquified gas, LPG, DME (dimethyl ether), or other desired gases may be used.

The liquifies gas is easily dissolved in the spray liquid, and is injected into the atmosphere together with the spray liquid from the spray hole 72. Since the liquified gas is abruptly vaporized and expanded, the spray liquid also becomes a fine mist.

Thus, the liquified gas should be used for forming the spray liquid in a fine mist after injection, and the injection of the spray liquid itself is done by the pressure of the vaporized gas, the blending amount in the spray liquid may be only very slight. Incidentally, the LPG is dissolved in alcohol, but is hardly dissolved in water, and the possible range of the dissolved amount varies with the injection set pressure, that is, the pressure in the container 1 by the vaporized gas.

A practical example of the relation between the spray liquid, liquified gas and injection set pressure, that is, the pressure in the container by the vaporized gas is shown in Table 1. Table 1 shows the possible range of the dissolved amount of liquified gas in the case of application of spray liquid and injection set pressure.

TABLE 1

| | Injection Set Pressure | Spray Liquid | | Liquified Gas | |
|---|---|---|---|---|---|
| (A) | 1 kg/cm$^2$ | 99% alcohol | 100 wt | LPG | 5.26 wt |
| (B) | 2 kg/cm$^2$ | same as (A) | | LPG | 10.87 wt |
| (C) | 3 kg/cm$^2$ | same as (A) | | LPG | 20.67 wt |
| (D) | 1 kg/cm$^2$ | same as (A) | | DME | 11.36 wt |
| (E) | 2 kg/cm$^2$ | same as (A) | | DME | 27.03 wt |
| (F) | 3 kg/cm$^2$ | same as (A) | | DME | 52.08 wt |
| (G) | 1 kg/cm$^2$ | refined water | 100 wt | DME | 4.79 wt |
| (H) | 2 kg/cm$^2$ | same as (G) | | DME | 9.50 wt |

TABLE 1-continued

| | Injection Set Pressure | Spray Liquid | | Liquified Gas | |
|---|---|---|---|---|---|
| (I) | 3 kg/cm$^2$ | same as (G) | | DME | 14.60 wt |
| (J) | 1 kg/cm$^2$ | 99% alcohol | 50 wt | LPG | 0.50 wt |
| | | refined water | 50 wt | | |
| (K) | 2 kg/cm$^2$ | same as (J) | | LPG | 1.00 wt |
| (L) | 3 kg/cm$^2$ | same as (J) | | LPG | 1.60 wt |
| (M) | 1 kg/cm$^2$ | same as (J) | | DME | 8.92 wt |
| (N) | 2 kg/cm$^2$ | same as (J) | | DME | 20.01 wt |
| (O) | 3 kg/cm$^2$ | same as (J) | | DME | 34.51 wt |
| (P) | 1 kg/cm$^2$ | 99% alcohol | 30 wt | LPG | 0.27 wt |
| | | refined water | 70 wt | | |
| (Q) | 2 kg/cm$^2$ | same as (P) | | LPG | 0.57 wt |
| (R) | 3 kg/cm$^2$ | same as (P) | | LPG | 0.95 wt |
| (S) | 1 kg/cm$^2$ | same as (P) | | DME | 6.53 wt |
| (T) | 2 kg/cm$^2$ | same as (P) | | DME | 14.51 wt |
| (U) | 3 kg/cm$^2$ | same as (P) | | DME | 26.79 wt |

In the case of (A) in Table 1, for example, when the injection set pressure, that is, the pressure in the container 1 by the vaporized gas is 1 kg/cm$^2$, in 100 wt of spray liquid composed of 99% alcohol, the LPG can be dissolved by up to 5.26 wt. That is, a proper amount of LPG less than 5.26 wt is dissolved in 100 wt of spray liquid of 99% alcohol, and is contained in the container 1. In Table 1, meanwhile, the temperature of the spray liquid and liquified gas is 25° C., and the LPG at this temperature possesses a pressure of 4.4 kg/cm$^2$, while DME, 4.7 kg/cm$^2$.

Thus, in the invention, the spray liquid to be injected from the nozzle hole at an adequate pressure from the pool is once stored in the pool, and is sent into the spray hole after being raised to the specified pressure, and therefore the spray liquid can be injected from the spray hole always at a specific pressure in the pool, regardless of the internal pressure in the pool.

Hence, the spray liquid can be sent out at a specific pressure staying always in the poor from beginning till end of use, and constant spray state and mist state can be maintained.

Furthermore, by dissolving a desired liquified gas in the spray liquid, the liquified gas is vaporized when the spray liquid is injected, and the spray liquid is formed in a fine mist, so that a favorable atomization state may be achieved.

Accordingly, the invention presents a spray mechanism of aerosol product capable of maintaining a constant spray state and mist state always from beginning till end of use, even when injecting the spray liquid by vaporized gas.

What is claimed is:

1. A spray mechanism for an aerosol product having at least a spray liquid and a spraying gas stored in a container, said spray mechanism comprising:

a spray hole formed in said control member;

a nozzle having a nozzle opening, said nozzle being provided in the container for supplying the aerosol product to said control member;

a control part for selectively supplying the spray liquid from said nozzle opening to said control member;

a regulator mechanism unit communicating with the nozzle opening and the spray hole, the regulator mechanism unit comprises a chamber formed at a front end of the nozzle in said control member, a sliding member provided slidably in the chamber, and thrusting means for thrusting the sliding member always toward the nozzle, the chamber including an opening formed at the front end of the nozzle so as to communicate with the nozzle opening, a communicating part to communicate with the chamber opening, and a connection hole disposed between the chamber and the chamber opening for communicating therebetween, the sliding member includes a partition wall disposed in the communicating part, and a shielding part disposed in the chamber opening and connected to the partition wall to be movable together with the partition wall, and wherein the sliding member slides in a direction resisting the thrusting force of the thrusting means by receiving first and second pressures greater than the thrusting force of the thrusting means by the spray liquid and gas released from the nozzle opening, wherein the shielding part shields and selectively closes the connection hole from the nozzle side along with the sliding motion of the sliding member in the direction resisting the thrusting force of the thrusting means, the partition wall slidably contacts with an inner circumference of the communicating part and communicates with the chamber opening in the communicating part, thereby forming a pool for temporarily storing the aerosol product flowing in from the chamber opening; and means for communicating between the pool and the spray hole, wherein the aerosol product is reserved in the pool until raised to a predetermined constant pressure maintained throughout dispensing into the spray hole through said means for communicating.

2. The spray mechanism according to claim 1, wherein said means for communicating includes a communicating hole for communicating with the pool, and a narrow communicating path for linking the communicating hole and the spray hole.

3. The spray mechanism according to claim 1, wherein said means for communicating includes a narrow leading path communicating with the pool, a communicating hole connected with the leading path, and a wide communicating path for communicating with the communicating hole and spray hole.

4. The spray mechanism according to claim 1, wherein the aerosol product of the container contains a spray liquid, liquified gas dissolved in the spray liquid, and a vaporized gas agent for spraying.

5. The spray mechanism according to claim 2, wherein the aerosol product of the container contains a spray liquid, a liquified gas dissolved in the spray liquid, and a vaporized gas agent for spraying.

6. The spray mechanism according to claim 3, wherein the aerosol product of the container contains a spray liquid, a liquified gas dissolved in the spray liquid, and a vaporized gas agent for spraying.

7. A spray mechanism for an aerosol product having at least a spraying liquid and a spraying gas stored in a container, said spray mechanism comprising:

a control member including a spray hole through which the aerosol products is dispensed;

means for connecting said control member to the container, said means for connecting including a nozzle fitting hole having a nozzle upper end abutting part;

a sliding member including a partition wall, a protruding shaft projecting downward from a lower surface of the partition wall, and a shielding part formed at an end of the protrusion opposing the partition wall, wherein the shielding part selectively mates with the nozzle fitting hole;

an upper lid positioned within an outer surface of said control member and in linear alignment with said sliding member;

thrusting means, positioned between said upper lid and said sliding member, for normally biasing said sliding member toward the nozzle fitting hole;

a constant pressure chamber formed within said control member and including a connecting hole at one side thereof surrounding the protruding shaft of said sliding member; and means for communicating said constant pressure chamber with the spray hole;

wherein supply of the aerosol product through the nozzle fitting hole applies a first pressure against the shielding part and a second pressure against the partition wall against said thrusting means until the shielding part closes the connecting hole, thereby trapping the aerosol product within said constant pressure chamber for dispensing through the spray hole, the sum of the first and second pressures being countered by a third and opposite pressure from said thrusting means, thereby maintaining a constant dispensing pressure within said constant pressure chamber.

8. The spray mechanism according to claim 7, wherein said thrusting means includes a spring member.

9. The spray mechanism according to claim 7, wherein said means for communicating includes a communicating hole for communicating with the constant pressure chamber and a narrow communicating path positioned between the communicating hole and the spray hole.

10. The spray mechanism according to claim 7, wherein the aerosol product of the container contains a spray liquid, a liquified gas dissolved in the spray liquid, and a vaporized gas agent for spraying.

* * * * *